United States Patent [19]

Haeder

[11] 4,034,165

[45] July 5, 1977

[54] TRANSDUCER WITH REARWARDLY DISPOSED DAMPING ELEMENTS

[75] Inventor: Gert Wilhelm Haeder, Schmitten, Germany

[73] Assignee: The Rank Organisation Limited, London, England

[22] Filed: Jan. 12, 1976

[21] Appl. No.: 648,516

[30] Foreign Application Priority Data

Jan. 22, 1975 United Kingdom ..... 2765/75

[52] U.S. Cl. ..... 179/115.5 R; 181/151; 181/166

[51] Int. Cl.[2] ..... H04R 1/02; H04R 1/28; H04R 9/02

[58] Field of Search ..... 179/115.5 R, 180; 181/146, 151, 166

[56] References Cited

UNITED STATES PATENTS

| | | | |
|---|---|---|---|
| 1,844,802 | 2/1932 | Seabert | 181/151 |
| 2,978,060 | 4/1961 | Roberts | 181/151 |
| 3,293,378 | 12/1966 | Heppner | 179/180 |
| 3,353,625 | 11/1967 | Scanlon | 181/151 |
| 3,393,764 | 7/1968 | Schafer | 181/146 |
| 3,720,285 | 3/1973 | Russell et al. | 181/151 |

*Primary Examiner*—George G. Stellar
*Attorney, Agent, or Firm*—Brisebois & Kruger

[57] ABSTRACT

A loudspeaker of the well known conical diaphragm moving coil type is provided with an annular, frusto-conical, cellular damping/deflection element on the magnet or magnet housing thereof. This element interferes with the rearward radiation of sound from the diaphragm and is of particular value when the loudspeaker is housed in a cabinet since it acts to inhibit the formation of standing waves due to reflection at the rear wall of the cabinet of the rearwardly directed radiation; this reduces the distortion of the forwardly radiated sound, caused by the rearwardly directed radiation reflected from the rear wall of the cabinet. A further cellular element, of generally cylindrical form, may be attached to the rim of the diaphragm so as to project rearwardly therefrom and surround the loudspeaker back to a line defined by the forwardmost part of the frusto-conical annular cellular element on the magnet or magnet housing.

13 Claims, 4 Drawing Figures

FIG. 2.
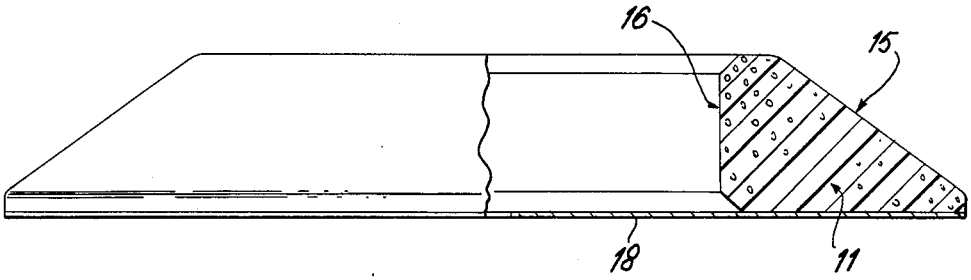
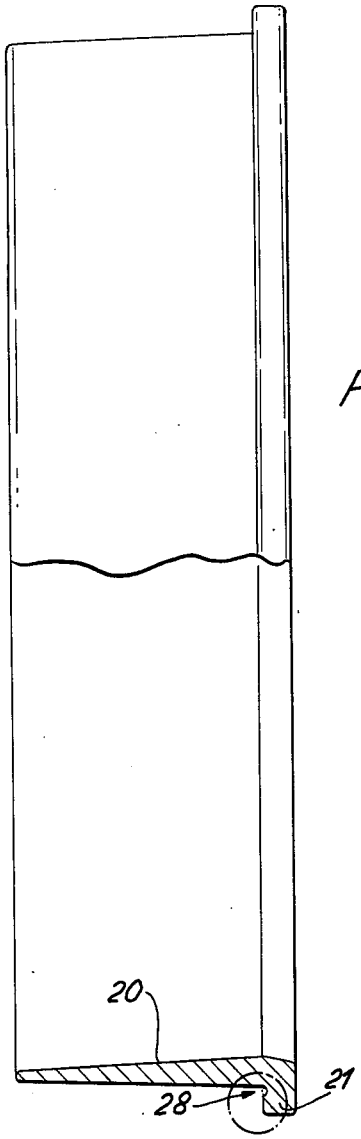
FIG. 3.
FIG. 4.
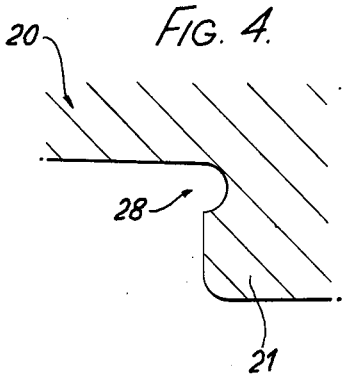

TRANSDUCER WITH REARWARDLY DISPOSED DAMPING ELEMENTS

The present invention relates to loudspeakers, and particularly to an improved loudspeaker assembly which is advantageous at least when used with bass loudspeakers.

It is usual to mount loudspeakers in substantially closed loudspeaker cabinets in order to improve the quality of sound produced thereby. When used hereinafter the term "loudspeaker assembly" will be understood to include an assembly comprising one or more loudspeakers mounted in an enclosure such as a cabinet. In many cases a loudspeaker assembly comprises a bass loudspeaker, a treble loudspeaker, and one or more intermediate frequency loudspeakers housed in a single cabinet which is substantially closed and airtight.

The reproduction of the bass frequency range in such a closed, airtight cabinet presents a number of problems particularly if, for acoustic reasons, the bass loudspeaker is installed asymmetrically with respect to the internal volume of the cabinet. In such circumstances there is a tendency, because of the high degree of stiffness of the air cushion, to the production of wobbling effects on the loudspeaker diaphragm, which are difficult to control. These effects lead mainly to K3 distortions.

The loudspeaker or each of the loudspeakers is normally mounted on a front face of the cabinet for radiation of acoustic vibrations forwardly. The rearwardly directed acoustic vibrations are radiated into the enclosed space of the cabinet itself and the effect of these rearwardly directed components of the total sound produced by the diaphragm of the loudspeaker is particularly difficult to eliminate entirely. In practice these components can only be damped and various systems for damping the rearwardly directed component of acoustic vibrations are known. These include filling the internal space of the cabinet with glass wool, cellular plastics material or the like. These arrangements are not all entirely successful, and as a result of the high stiffness of the air cushion within the interior of the cabinet a greater or lesser amount of the sound energy radiated rearwardly from the diaphragm of the loudspeaker is transmitted to the walls of the cabinet. Vibration analyses conducted on example cabinets have indicated that in the majority of cases the component of the loudspeaker cabinet which has the greatest tendency to vibrate is the rear wall, that is the wall directly opposite that wall on which the loudspeaker are supported.

Another problem which has been encountered in connection with the use of moving coil electrodynamic loudspeakers, particularly those designed for use in conjunction with high power rated amplifiers, is the problem of overheating of the magnet after a period of continuous use; this problem is exacerbated in circumstances where the total interior volume of the loudspeaker cabinet is filled with a cellular material since such materials normally have a thermal insulating effect as well as an acoustic insulating effect.

The present invention seeks to provide a loudspeaker construction, and an arrangement for loudspeaker cabinets in which the problem of K3 distortion due to rearwardly directed acoustic vibrations can be largely eliminated. Embodiments of the present invention can be constructed in which the magnet of an electrodynamic moving coil loudspeaker is provided with means for assisting in the dissipation of heat generated by the use thereof thereby avoiding the abovementioned disadvantage of overheating of the magnet.

According to the present invention a loudspeaker of the type in which a diaphragm is caused to vibrate in dependence on a varying electrical input signal so as to radiate acoustic vibrations forwardly from one face and rearwardly from the other face, is provided with a damping element of cellular material mounted on a fixed part of the loudspeaker in a position such as to absorb and/or deflect acoustic vibrations directed rearwardly from the diaphram.

The provision of such a cellular damping element in the path of rearwardly directed acoustic vibrations serves to deflect and/or absorb a proportion of these vibrations so that when the loudspeaker is mounted in an enclosed cabinet the rear wall of cabinet is relieved of the acoustic load. It has been found that, in addition, the resonance peaks of such an assembly are distributed statistically in a better manner from an acoustic point of view. In addition the provision of such an annular frusto-conical damping element serves to distribute the rearwardly directed sound waves in a more uniform manner in the interior of a loudspeaker cabinet and this acts against the generation of standing waves.

Preferably the diaphragm is substantially conical and a cylindrical element of cellular material is attached to the rim thereof and extends rearwardly so as to absorb and/or deflect at least some of the laterally directed components of the acoustic vibrations radiated from the rear face of the diaphragm. Similarly, it is preferred that if the diaphragm is substantially conical, the said damping element is a frusto-conical annular element.

Preferably the loudspeaker is a moving coil loudspeaker and the damping element of cellular material is mounted on the magnet or the magnet housing thereof. Such magnets or magnet housings are usually formed with at least part thereof in a substantially cylindrical shape and the annular damping element preferably surrounds at least part of the length of this cylindrical portion.

The orientation of the frusto-conical annular damping element is preferably such that the narrow end of the cone is nearest the diaphragm: with this orientation the conically tapered face of the damping element lies in the path of at least some of the rearwardly directed acoustic vibrations from the diaphragm and thus acts, in addition to partially absorbing these vibrations, to deflect these in a ring transversely with respect to the initial rearward direction of the vibrations. The structure of the material from which the damping element is made is preferably of such a nature that frequencies below about 1 kHz are additionally damped before they are further reflected.

In a preferred embodiment of the invention one face of the damping element is provided with a metal sheet in thermal contact with the magnet or magnet housing to assist in dissipating heat from the magnet. In embodiments in which, as mentioned above, the conically tapered face is directed towards the diaphragm of the loudspeaker, it is preferred that the substantially radial face of the element is provided with a metal sheet for heat dissipating purposes.

It is preferred that the cellular material of the damping element is partly porous, that is has only a proportion of the cells thereof intercommunicating with one another.

The present invention also comprehends a loudspeaker assembly comprising a substantially closed cabinet housing at least one loudspeaker, having a damping element as defined above, mounted in an opening in a front wall thereof.

In a preferred embodiment the loudspeaker diaphragm is substantially conical and a cylindrical element of cellular material is attached to the rim thereof, the cylindrical element having a radial flange which is sandwiched between the rim of an opening in the front wall of the cabinet and the rim of the loudspeaker. The radial flange of the cylindrical cellular element may be secured by adhesive to the rim of the opening in the front wall of the cabinet and to the rim of the loudspeaker.

One embodiment of the present invention will now be more particularly described, by way of example, with reference to the accompanying drawings, in which:

FIG. 2 is an axial section of one component of the embodiment of FIG. 1;

FIG. 3 is an axial section of another component of the embodiment of FIG. 3; and FIG. 4 is an enlarged detail view of a part of FIG. 3.

Figure 1:
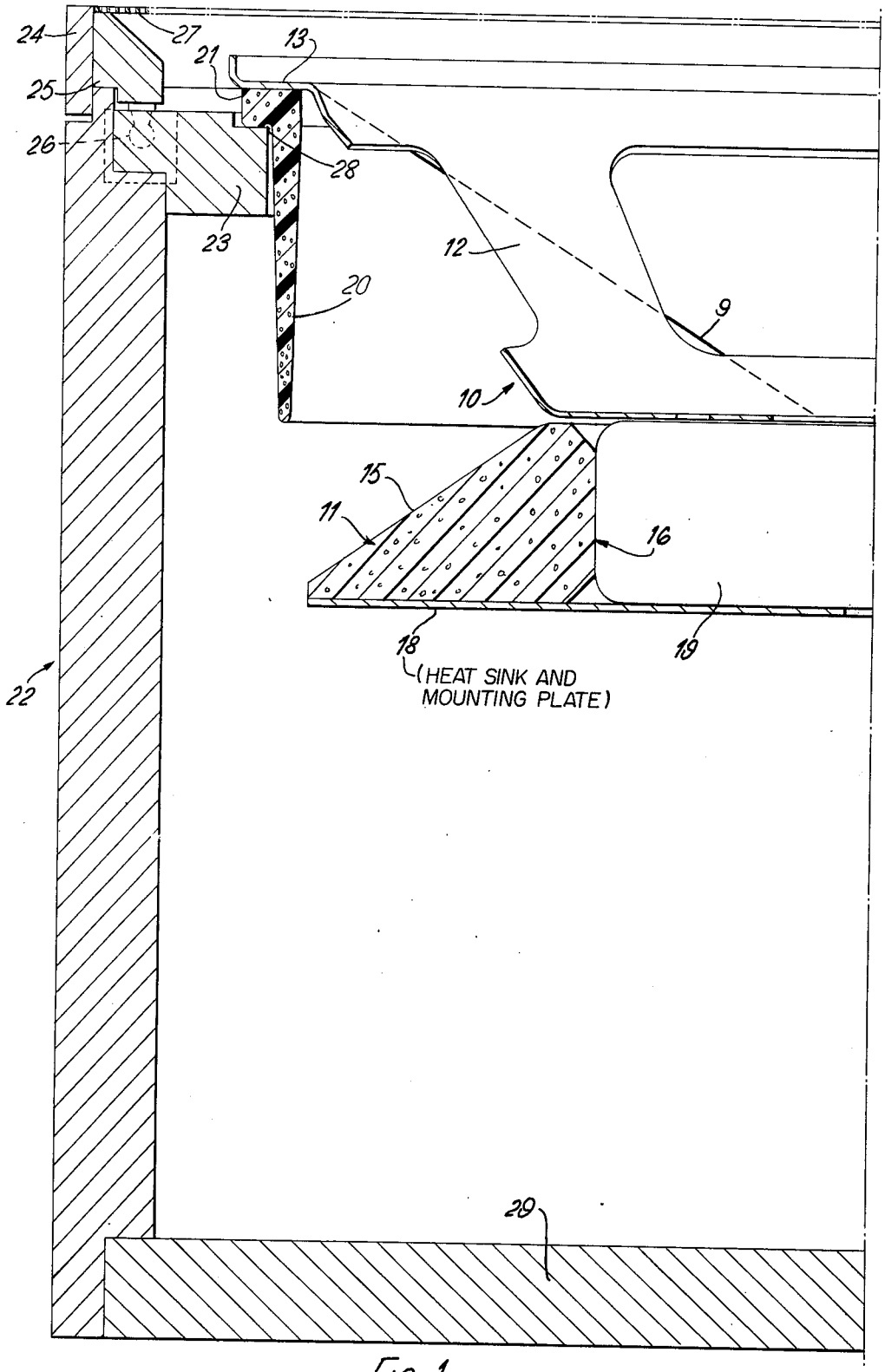
FIG. 1 is a schematic axial sectional view of part of a loudspeaker assembly formed as an embodiment of the invention.

In the drawing there is shown a loudspeaker, generally indicated 10, of the moving coil type having a pierced frusto-conical supporting frame 12 the rim 13 of which supports the outer rim of a conical diaphragm 9 which is linked to a coil (not shown) which is surrounded by a permanent magnet 19.

In use of such a loudspeaker the coil is caused to oscillate axially along the axis of the magnet 19 by the application of a varying electrical signal, and this oscillation causes vibrations of the diaphragm which cause acoustic vibrations to be radiated both forwardly (that is towards the top of FIG. 1) and rearwardly (that is towards the bottom of FIG. 1). The loudspeaker 10 is mounted in an enclosure in the form of a loudspeaker cabinet, generally indicated 22 and is supported by the rim 13 in an opening in one wall 23 of the cabinet 22, this wall normally being considered as the front of the cabinet. Rearwardly directed acoustic vibrations generated by the diaphragm of the loudspeaker 10 thus travel into the cabinet 22 itself and in order to obviate the undesirable effects discussed above there is provided an annular damping element 11 of frusto-conical form mounted around the magnet 19. The element 11 has a radial face to which is attached a metal disc 18 by means of which the element 11 is secured to the magnet 19, and which serves to assist in dissipating the heat generated in the magnet 19 by use of the loudspeaker.

The damper element 11, which is separately shown in FIG. 2, has a cylindrical inner face 16 and a frusto-conical face 15 which is directed towards the diaphragm 14. The material from which the damper element 11 is made is a partly porous cellular material, that is one in which not all the cells intercommunicate, and this acts to absorb rearwardly directed acoustic vibrations from the diaphragm 14, and the frusto-conical face 15 acts to deflect vibrations laterally with respect to the axis of the loudspeaker. Such lateral deflection relieves the acoustic loading on the rear wall of a cabinet in which the loudspeaker may be housed, and it can be shown that this reduces the K3 distortion to a barely measurable amount in some cases.

The use of a mounting disc 18 on the radial face of the damping element 11 obviates the necessity for providing magnet coverings having cooling ribs which are, in general, more expensive to manufacture.

The loudspeaker 10 is also provided with a further cylindrical element 20 of cellular material, separately shown in FIG. 3. The element 20 is attached to the rim 13 of the frame 12 of the loudspeaker 10. The cylindrical element 20 has an outwardly directed radial flange, shown in detail in FIG. 4, which is sandwiched between the rim 13 of the frame 12 of the loudspeaker and the rim of the opening in the front wall 23 of the cabinet 22 to each of which it is secured by adhesive or other means. It will be noted that the corner where the annular flange 21 meets the cylindrical portion of the element 20 is formed with an annular groove 28. This groove 28 ensures that the maximum axial length of the wall of the cylindrical element 20 is spaced away from contact with the opening in the front wall 23 of the cabinet 22 so that the damping effect of the cellular cylindrical element 20 is not impaired. A perforated grill or front cover 27 is held in position spaced from the front wall 23 of the cabinet 22 by a frame element 24 having a plurality of locating blocks 25 from which project locating studs 26 received in spaced recesses in the front wall 23.

The combined effect of the two cellular damping elements is to absorb and deflect rearwardly directed acoustic vibrations from the loudspeaker diaphragm thereby reducing the internal wall loading on the cabinet 22, particularly the wall 29, to reduce the distortions introduced by vibrations of the cabinet walls and also those due to standing waves set up by reflections from the cabinet walls.

I claim:

1. In a loudspeaker of the type comprising:

a substantially conical diaphragm, support means for said diaphragm, and means for causing said diaphragm to vibrate in dependence on a varying electrical input signal fed to said loudspeaker, whereby said diaphragm radiates acoustic vibrations forwardly from one face and rearwardly from the other face, the improvement wherein, there is provided a frusto-conical annular damping element of cellular material mounted on said support means of said loudspeaker in a position such as partly to absorb and partly to radially outwardly deflect acoustic vibrations directed rearwardly from said disphragm.

2. The loudspeaker of claim 1, wherein said frusto-conical annular damping element is positioned, with the narrow end thereof nearest said diaphragm such that rearwardly traveling acoustic waves from said diaphragm impinge on the conical face thereof.

3. The loudspeaker of claim 1, wherein the cellular material of said damping element is partly porous, that is only a proportion of the cells thereof are intercommunicating.

4. A loudspeaker assembly comprising a substantially closed cabinet housing at least one loudspeaker according to claim 1, said loudspeaker being mounted in an opening in a front wall of said cabinet.

5. The loudspeaker of claim 1, wherein said diaphragm is substantially conical and there is further provided:

a substantially cylindrical element of cellular material attached to the rim of said loudspeaker, said substantially cylindrical element extending rearwardly of said rim spaced from said frusto-conical annular clamping element, and acting so as partly to absorb and partly to deflect laterally directed components of the acoustic vibrations radiated from the rear face of said diaphragm.

6. The loudspeaker of claim 5, wherein said substantially cylindrical element of cellular material is partly porous, that is only a proportion of the cells thereof are intercommunicating.

7. A loudspeaker as in claim 1, having a moving coil and a magnet in a magnet housing, and wherein said damping element of cellular material is mounted on said magnet or said magnet housing of said loudspeaker.

8. The loudspeaker of claim 7, wherein said magnet or said magnet housing is substantially cylindrical, and said annular damping element surrounds at least part of the length thereof.

9. The loudspeaker of claim 7, wherein one face of said damping element is provided with a metal sheet in thermal contact with said magnet or magnet housing to assist in dissipating heat from said magnet.

10. A loudspeaker assembly comprising a substantially closed cabinet housing at least one loudspeaker comprising:

a substantially conical diaphragm, support means for said diaphragm, means for causing said diaphragm to vibrate in dependence on a varying electrical input signal fed to said loudspeaker, whereby said diaphragm radiates acoustic vibrations forwardly from one face and rearwardly from the other face, a damping element of cellular material mounted on said support means of said loudspeaker in a position such as partly to absorb and partly to deflect acoustic vibrations directed rearwardly from said diaphragm, and a further substantially cylindrical element of cellular material attached to the rim of said loudspeaker, said loudspeaker being mounted in an opening in a front wall of said cabinet, and said substantially cylindrical element having a radial flange which is sandwiched between the rim of said opening in said front wall of said cabinet and the rim of said loudspeaker.

11. The loudspeaker assembly of claim 10, wherein the rearward end of said cylindrical damping element is substantially in register with the forward end of said damping element.

12. The loudspeaker assembly of claim 10, wherein said radial flange of said substantially cylindrical cellular element is secured by adhesive to said rim of said opening in said front wall of said cabinet and to said rim of said loudspeaker.

13. The loudspeaker assembly of claim 12, wherein the cylindrical wall of said substantially cylindrical cellular element is spaced radially inwardly from said opening in said front wall of said cabinet which is contacted solely by said radial flange of said cylindrical cellular element.

* * * * *